US006035931A

United States Patent [19]

Kado et al.

[11] Patent Number: 6,035,931

[45] **Date of Patent: *Mar. 14, 2000**

[54] HEADER OF HEAT EXCHANGER

[75] Inventors: Hirotaka Kado, Isesaki; Akimichi Watanabe, Maebashi, both of Japan

[73] Assignee: Sanden Corporation, Gunma, Japan

[ * ] Notice: This patent issued on a continued prosecution application filed under 37 CFR 1.53(d), and is subject to the twenty year patent term provisions of 35 U.S.C. 154(a)(2).

This patent is subject to a terminal disclaimer.

[21] Appl. No.: 08/637,274

[22] Filed: Apr. 25, 1996

[30] Foreign Application Priority Data

May 30, 1995 [JP] Japan ..... 7-154040

[51] Int. Cl.[7] ..... F28F 9/02

[52] U.S. Cl. ..... 165/174; 165/173; 165/153; 165/175

[58] Field of Search ..... 165/153, 173, 165/174, 175, 176; 29/890.043, 890.052

[56] References Cited

U.S. PATENT DOCUMENTS

| | | | |
|---|---|---|---|
| 475,656 | 5/1892 | Bertels . | |
| 2,073,778 | 3/1937 | Boerger | 165/173 |
| 2,229,207 | 1/1941 | Hansen | 165/173 |
| 3,757,855 | 9/1973 | Kun et al. | 165/166 |
| 3,993,126 | 11/1976 | Taylor | 165/173 |
| 4,041,594 | 8/1977 | Chartet | 165/153 X |
| 4,234,041 | 11/1980 | Melnyk | 165/173 |
| 4,547,943 | 10/1985 | Hoeffken | 29/890.043 |
| 4,678,112 | 7/1987 | Koisuka et al. | 165/173 X |
| 5,052,475 | 10/1991 | Grundy | 165/173 X |
| 5,174,373 | 12/1992 | Shinmura . | |
| 5,236,042 | 8/1993 | Kado | 165/173 X |
| 5,236,336 | 8/1993 | Hitoshi . | |
| 5,240,068 | 8/1993 | Tokutake | 165/173 X |
| 5,297,624 | 3/1994 | Haussmann et al. | 165/173 |
| 5,348,081 | 9/1994 | Halstead et al. | 165/153 X |
| 5,366,007 | 11/1994 | Hutto et al. | 165/153 X |
| 5,390,733 | 2/1995 | Young | 165/153 X |
| 5,540,278 | 7/1996 | Chiba et al. | 165/173 X |
| 5,546,761 | 8/1996 | Matsuo et al. | 165/173 X |
| 5,787,973 | 8/1998 | Kado et al. | 165/175 X |

FOREIGN PATENT DOCUMENTS

| | | | |
|---|---|---|---|
| 0371532 | 6/1990 | European Pat. Off. . | |
| 58-49897 | 3/1983 | Japan . | |
| 59-225900 | 12/1984 | Japan . | |
| 0186695 | 9/1985 | Japan | 165/173 |
| 0076890 | 4/1986 | Japan | 165/173 |
| 0036497 | 2/1991 | Japan | 165/173 |
| 3121375 | 12/1991 | Japan . | |
| 1017521 | 12/1962 | United Kingdom . | |

*Primary Examiner*—Christopher Atkinson
*Attorney, Agent, or Firm*—BakerBotts, LLP

[57] ABSTRACT

A header of a heat exchanger includes a seat member having bent portions on its end portions, a tank member having side walls on its end portions, and a pair of caps sealing the open ends of a barrel formed from the seat member and the tank member. Each side wall has a free end portion bent inwardly by an amount substantially equal to a thickness of the bent portion. The inner surface of each bent portion and the outer surface of each offset free end portion are joined to form the barrel. Thus, protrusions on the exterior shape of the formed barrel are eliminated, thereby eliminating contours from the shape of each cap provided on each open end of the barrel.

7 Claims, 5 Drawing Sheets

HEADER OF HEAT EXCHANGER

BACKGROUND OF THE INVENTION

1. Field of the Invention

The present invention relates to a header for a heat exchanger, and more particularly to a header constructed as a tank structure from at least two members joined to each other.

2. Description of the Related Art

A structure of a header for heat exchangers formed from two members is known, for example, as disclosed in Japanese Utility Model Laid-Open HEI 3-121375. In this structure, as shown in FIG. 8, a pair of curved members 101 and 102 are joined to each other to form a barrel 103 of a header 104. Free end portions 102*a* of member 102 are offset outwardly, and the inner surfaces of free end portions 102*a* and the outer surfaces of the end portions of member 101 are joined to each other. A cap 105 is provided, so that the cap 105 seals each open end of the formed barrel 103 from the exterior.

In such a structure, because free end portions 102*a* of member 102 are offset outwardly, protruding portions are formed on the outer surface of the barrel 103. Therefore, the inner surface of cap 105 is formed in a shape conforming to the exterior shape of barrel 103 including the protruding portions, and the shape of the inner surface of cap 105 and the structure of the cap 105 itself are complicated.

SUMMARY OF THE INVENTION

It is an object of the present invention to provide a header for a heat exchanger wherein the shape of a cap provided on each end opening of a barrel forming the header is simplified.

The above and other objects are achieved by a header for a heat exchanger according to the present invention comprising a seat member having a first and a second seat end portion and a bent portion on each end portion of the seat member in a radial direction of the seat member, a tank member having a first and a second tank end portion and a side wall on each end portion of the tank member in a radial direction of the tank member. Each of the side walls has a free end portion extending toward a tip of the side wall which is offset inwardly by an amount substantially equal to a thickness of the bent portion. The seat member and the tank member form a barrel of the header, having a first and second end opening, by engagement of an inner surface of each bent portion with an outer surface of each free end portion. A cap member is fitted to each end opening of the barrel in an axial direction of the barrel from an exterior side of each end portion of the barrel.

The seat member may comprise, for example, a planar plate portion and a first and a second bent portion provided on the respective end portions of the planar plate portion in a radial direction of the planar plate portion. Alternatively, the seat member may comprise a planar plate portion, a first and a second curved portion provided on the respective end portions of the planar plate portion in a radial direction of the planar plate portion for forming a groove which receives one of free end portions of the tank member on one of the curved portions, and a first and a second bent portion connected to respective outer ends of the curved portions. The bent portions may extend, for example, perpendicularly to the planar plate portion.

Each side wall of the tank member may be inclined outwardly in a direction, such that the tips of the side walls extend away from each other. In an embodiment in which a partition is disposed in the barrel, a portion of the tank member, which contacts with the partition except for each offset free end portion, may be bent inwardly by an amount corresponding to an offset amount of the free end portion.

In such a header for a heat exchanger according to the present invention, each free end portion of the tank member is offset inwardly by an amount substantially equal to a thickness of the bent portion of the seat member. When the tank member and the seat member are joined to each other to form a barrel, i.e., when the inner surface of each bent portion is joined to the outer surface of each free end portion, the outer surface of each side wall of the tank member, except the outer surface of the free end portion, and the outer surface of each bent portion of the seat member are flush in the same plane. Therefore, there is no protruding portion on the exterior surface of the barrel formed by the seat member and the tank member, and the exterior shape of the barrel may be simplified. As a result, the shape of the cap member, particularly, the inner shape of the cap member, which is fitted to the axial end portion of the barrel from outer side of the barrel, may be simplified.

In an embodiment in which the side walls of the tank member are inclined outwardly, when the outer surfaces of the free end portions join the inner surfaces of the bent portions, the side walls are deformed inwardly, such that an elastic urging force is created in an outward direction. A surface pressure is generated between the inner surfaces of the bent portions and the outer surfaces of the free end portions, which are joined to each other. As a result, relative displacement between the tank member and the seat member may be suppressed by a frictional force due to the surface pressure, and preservation of the form of the header during heating and brazing of an assembled heat exchanger in a furnace may be facilitated.

Further, in an embodiment in which curved portions, each forming a groove receiving each free end portion, are provided on the seat member, the contact area between the seat member and the tank member increases, thereby, increasing the area for brazing between the seat member and the tank member and, consequently, increasing the strength of the header of a completed heat exchanger.

Further, in an embodiment in which a partition is disposed in the barrel, and a portion of the tank member is joined to the partition, except that each offset free end portion is bent inwardly by an amount corresponding to an offset amount of the free end portion, there is no partially protruding or recessed portion along the portion on the inner surface of the barrel in contact with the periphery of the partition. Therefore, the shape of the partition may also be simplified.

Further objects, features, and advantages of the present invention will be understood from the following detailed description of the embodiments of the present invention with reference to the appropriate figures.

BRIEF DESCRIPTION OF THE DRAWINGS

Some embodiments of the invention will now be described with reference to the appropriate figures. However, these embodiments are exemplary and are not intended to limit the present invention.

DETAILED DESCRIPTION OF THE INVENTION

Figure 1:
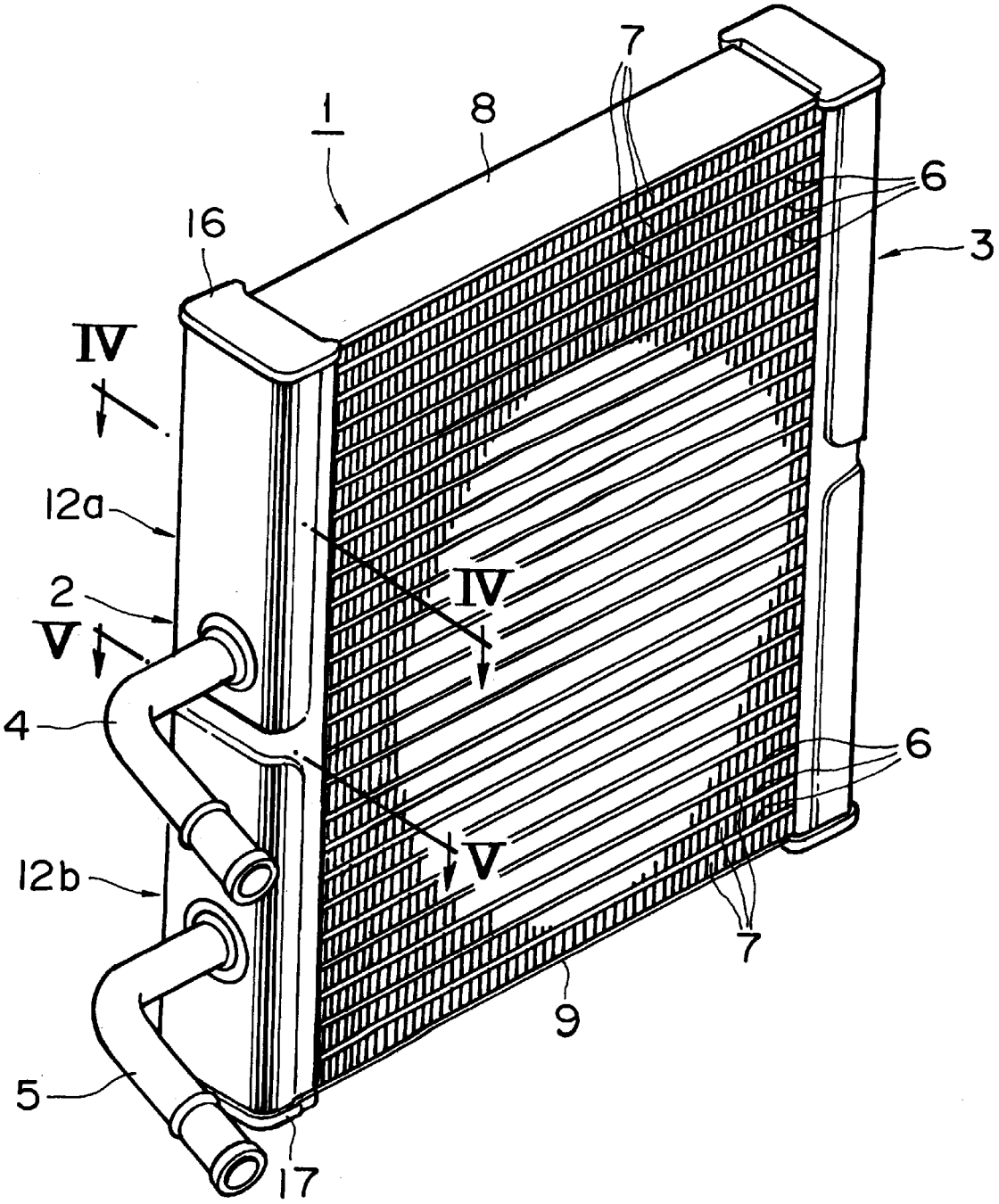
FIG. 1 is a perspective view of a heat exchanger having headers according to a first embodiment of the present invention.
Figure 2:
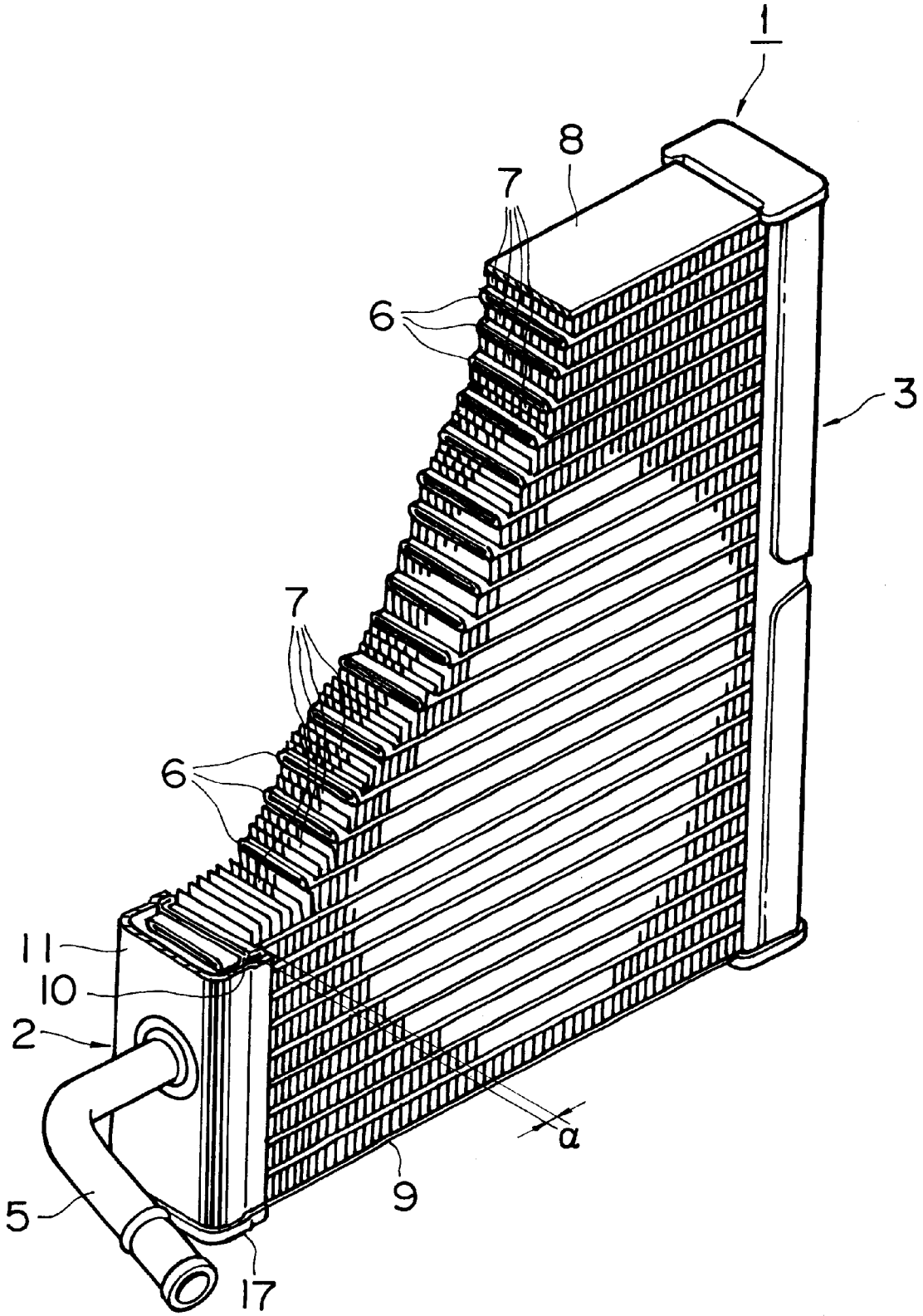
FIG. 2 is a partially cut away, perspective view of the heat exchanger depicted in FIG. 1.

Referring to FIGS. 1 and 2, a heat exchanger 1 is provided according to a first embodiment. Heat exchanger 1 includes a pair of headers 2 and 3 each formed as a barrel-type tank structure. Inlet pipe 4 and outlet pipe 5 are connected to header 2. A plurality of flat heat transfer tubes 6, for example, refrigerant tubes, are fluidly interconnected between headers 2 and 3. Corrugated fins 7 are disposed on both surfaces of each heat transfer tube 6. Side members 8 and 9 are provided on the upper surface of the uppermost fin 7 and on the lower surface of the lowermost fin 7, respectively.

Figure 3:
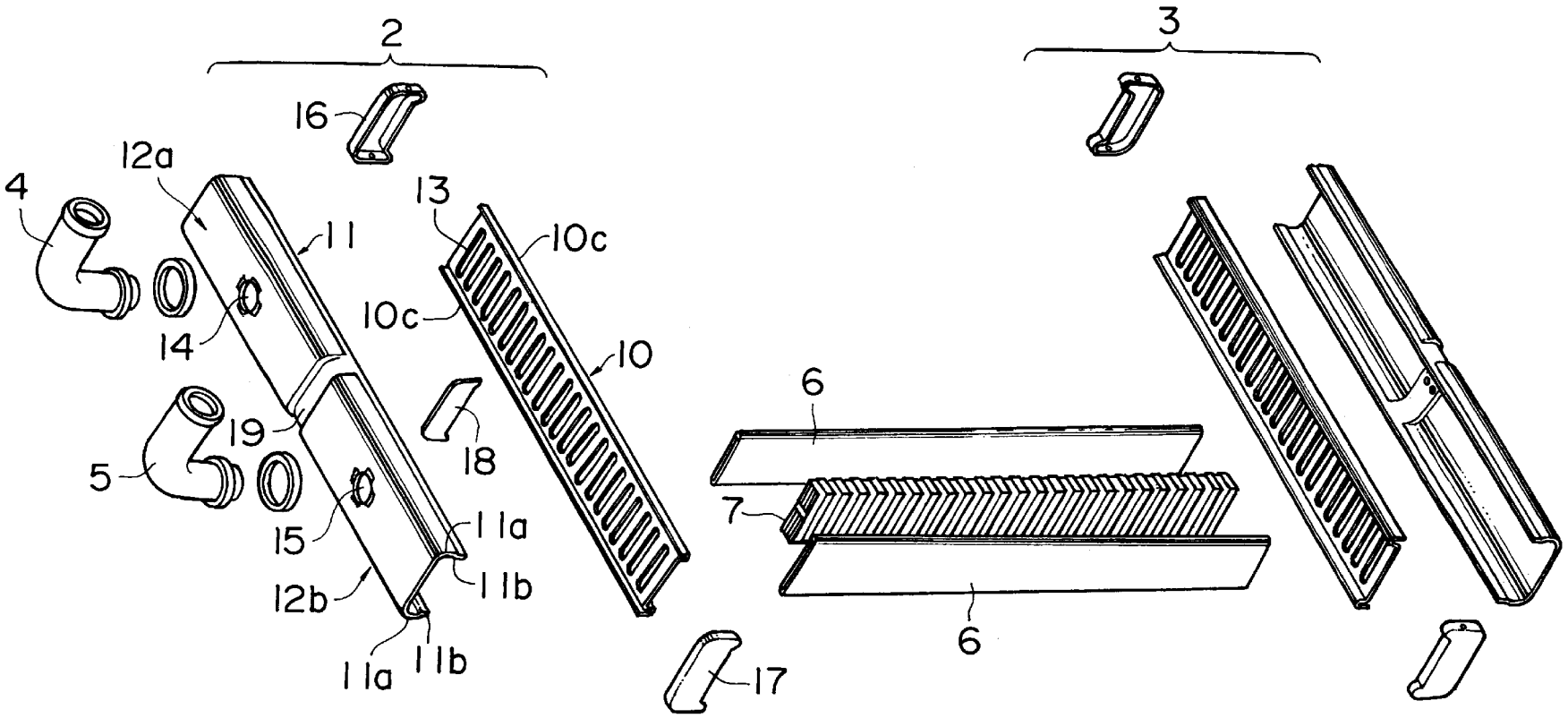
FIG. 3 is an expanded perspective view of the heat exchanger depicted in FIG. 1.
Figure 4:
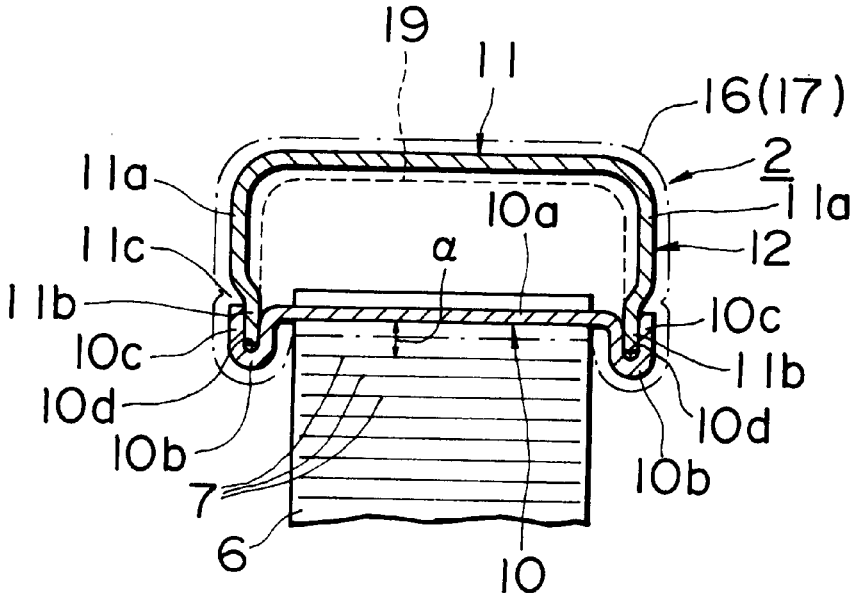
FIG. 4 is an enlarged cross-sectional view of a header of the heat exchanger depicted in FIG. 1 along line IV—IV.

As depicted in FIGS. 3 and 4, header 2 has seat member 10 and tank member 11. Seat member 10 and tank member 11 are joined to each other to form a barrel 12. Seat member 10 includes planar plate portion 10*a*, curved portions 10*b* provided on the respective transverse end portions of planar plate portion 10*a*, and bent portions 10*c* connected to the respective outer ends of curved portions 10*b*. Each curved portion 10*b* forms groove 10*d* therein. Each bent portion 10*c* extends substantially perpendicularly to planar plate portion 10*a*. Seat member 10 has a plurality of slit holes 13 into which end portions of the respective heat transfer tubes 6 are inserted.

Tank member 11 has a U-shape cross-section and has side walls 11*a* on both end portions in its radial direction. Each side wall 11*a* has free end portion 11*b* extending toward the tip of the side wall 11*a* offset inwardly by an amount substantially equal to the thickness of bent portion 10*c* of seat member 10. Tank member 11 also may have openings 14 and 15. Inlet pipe 4 may be inserted into opening 14, and outlet pipe 5 may be inserted into opening 15.

Free end portions 10*b* of tank member 11 are inserted into the respective grooves 10*d* of seat member 10. The inner surface of each bent portion 10*c* of seat member 10 is joined to the outer surface of each free end portion 11*b*. Seat member 10 and tank member 11 are joined, e.g., brazed, to each other to form barrel 12 having a substantially rectangular cross-section. Cap members 16 and 17 are provided on a first and a second end openings of barrel 12, respectively. Cap members 16 and 17 have an inner circumferential shape corresponding to the outer circumferential shape of the first and second end openings of barrel 12. Cap members 16 and 17 are fitted to the respective end openings of barrel 12 from the exterior of the barrel 12 and seal the first and second end openings of the barrel 12, respectively.

Figure 5:
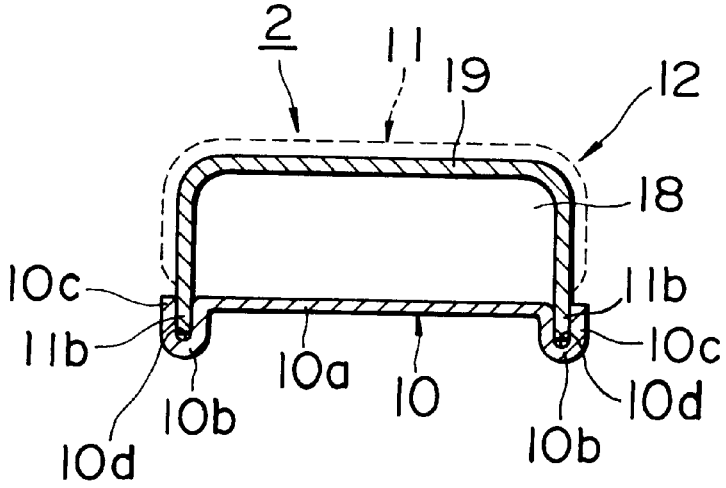
FIG. 5 is an enlarged cross-sectional view of another portion of the header of the heat exchanger depicted in FIG. 1 along line V—V.

As depicted in FIGS. 3 and 5, a partition 18 may be disposed in barrel 12. The interior of barrel 12, e.g., header 2, may be divided into at least two sections 12*a* and 12*b* by partition 18. As indicated by a broken line in FIG. 4 and as indicated by a solid line in FIG. 5, portion 19 of tank member 11 is joined to partition 18. However, free end portions 11*b* are bent inwardly by an amount corresponding to an offset amount of each free end portion 11*b*.

Header 3 may have substantially the same structure as that of header 2. However, header 3 may not have openings for inlet and outlet pipes and a partition.

The above-described members may be constructed from aluminum or an aluminum alloy. The respective members may be assembled in a form of a heat exchanger, and the assembly may then be heated in a furnace and the mambers may be brazed to each other to complete fabrication of a heat exchanger.

In header 2 of heat exchanger 1 according to the above-described embodiment, free end portions 11*b* of side walls 11*a* of tank member 11 are offset inwardly by an amount substantially equal to a thickness of each bent portion 10*c* of seat member 10. When tank member 11 and seat member 10 engage each other between the respective inner surfaces of bent portions 10*c* and the respective outer surfaces of offset free end portions 11*b*, the outer surface of each side wall 11*a* of tank member 11, except at the outer surface of each offset free end portion 11*b*, is flush with the outer surface of each bent portion 10*c* of seat member 10. Therefore, there is no outwardly protruding portion on the exterior surface (periphery) of barrel 12, formed when tank member 11 and seat member connected to each other, as shown in FIG. 4. Consequently, cap members 16 and 17 sealing barrel 12 from its exterior may be simplified in shape.

If a portion 11*c* of cap member 16 (or 17) positioned adjacent to the tip of bent portion 10*c* is formed bent slightly inward, portion 11*c* may seal a substantially rectangular space formed between the outer surface of barrel 12 and the inner surface of cap 16 (or 17) at a position adjacent to the tip of bent portion 10*c*. Therefore, cap 16 (or 17) may seal the first (or second) end portion of barrel 12 more completely. Alternatively, however, this above-described substantially rectangular space may be readily and adequately filled with a brazing material.

Further, in this embodiment, curved portions 10*b* are provided on both end portions of seat member 10 to form grooves 10*d* for receiving free end portions 11*b*. Therefore, the contact area between tank member 11 and seat member 10 increases, and consequently, the brazing area therebetween may be increased. As a result, the strength of a completed heat exchanger also may be increased.

These curved portions 10*b* may serve another function. As shown in FIG. 2, a space $\alpha$, e.g., a gap, may be formed between an end of fin 7 and seat member 10 for preventing a molten brazing material from flowing from the header side to the fin side at the time of heating in a furnace and, thereby, for preventing the reduction of the amount of the brazing material at a connecting position between header 2 and tube 6. However, because such a space $\alpha$ allows air to flow therethrough, the efficiency of a heat exchanger may be decreased by the presence of the space $\alpha$. In this embodiment, as shown in FIG. 4, curved portions 10*b* seal space $\alpha$ formed between seat member 10 and an end of fin 7 from both sides; air passage through space $\alpha$ is thus reduced or eliminated, and a decrease of the heat exchange efficiency of heat exchanger 1 may be reduced or prevented.

Further, in this embodiment, portion 19 of tank member 11 is joined to partition 18 except at free end portions 11*b* which are bent inwardly by an amount corresponding to an offset amount of each free end portion 11*b*. Therefore, no protruding portion exists along the contact portion of the inner surface of barrel 12 with partition 18. Consequently, the outer shape of partition 18 may also be simplified.

Although header 2 has been described in detail above, similar advantages may be obtained with respect to header 3 having a structure similar to that of header 2.

Figure 6:
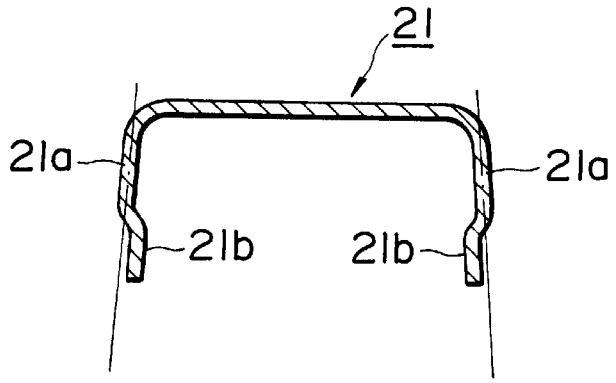
FIG. 6 is a cross-sectional view of a tank member of a heat exchanger according to a second embodiment of the present invention.

In another embodiment, side walls of a tank member may be slightly inclined outwardly. For example, as depicted in FIG. 6 showing a second embodiment of the present invention, each side wall 21*a* of tank member 21 is slightly inclined outwardly in a direction, such that the tips of side walls 21*a* (tips of offset free end portions 21*b*) are inclined away from each other.

In such a structure, when side walls 21*a* are elastically deformed inwardly and the outer surface of each offset free end portion 21*b* engages the inner surface of a bent portion of a seat member, an elastic urging force directed in an outward direction is created in each offset free end portion 21*b*. As a result, relative displacement between tank member 21 and the seat member may be reduced or eliminated by a frictional force due to the surface pressure generated therebetween, and a desired assembly form of a header may be more accurately maintained during heating and brazing of the assembly in a furnace.

Figure 7:
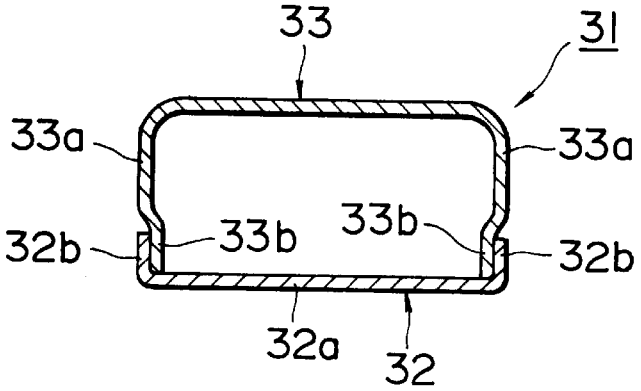
FIG. 7 is a cross-sectional view of a header of a heat exchanger according to a third embodiment of the present invention.
Figure 8:
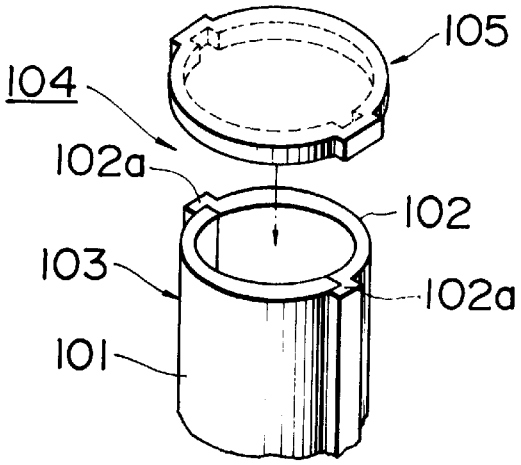
FIG. 8 PRIOR ART
FIG. 8 is an expanded perspective view of a part of a conventional header.

Further, as depicted in FIG. 7, seat member 32 may comprise only planar plate portion 32*a* and bent portions 32*b* formed on both end portions of planar plate portion 32*a*. In such a structure, tank member 33 has side walls 33*a*, and each side wall 33*a* has free end portion 33*b* offset by an amount substantially equal to the thickness of each bent portion 32*b*. Therefore, a header 31 having a simple exterior shape may be realized.

Although several embodiments of the present invention have been described in detail herein, the invention is not limited thereto. It will be appreciated by those skilled in the art that various modifications may be made without departing from the scope of the invention. Accordingly, the embodiments disclosed herein are exemplary only. It is to be understood that the scope of the invention is not to be limited thereby, but is to be determined by the claims which follow.

What is claimed is:

1. A header of a heat exchanger comprising:

a seat member comprising a planar plate portion, a first and second curved portion provided on the respective end portions of said planar plate portion in a radial direction of said planar plate for forming a groove and a first and a second bent portion connected to the respective ends of said curved portions, wherein said seat member has a plurality of tube insertion holes for receiving end portions of a plurality of flat heat transfer tubes;

a tank member having a first and a second tank end portion and a side wall on each end portion of said tank member in a radial direction of said tank member, each of said side walls having a free end portion extending toward a tip of said side wall and bent inwardly by an amount substantially equal to a thickness of said bent portions, said seat member and said tank member forming a barrel of said header, having a first and a second end opening in an axial direction of said barrel, by engagement of an inner surface of each said bent portion with an outer surface of each said free end portion, such that said barrel does not have outwardly protruding portions on both exterior side surfaces of said barrel positioned at each of said first and second openings, said first and second bent portions of said seat member flush said side walls of said tank member, wherein said grooves of said curved portions receive therein said free end portions of said side walls;

a plurality of fins adjacent to said seat member, said curved portions sealing a space formed between said plurality of fins and said seat member; and a cap member fitted to each end opening of said barrel from the exterior of said each end opening of said barrel.

2. The header of a heat exchanger of claim 1, wherein said bent portions extend perpendicularly to said planar plate portion.

3. The header of a heat exchanger of claim 1, wherein said tank member has a U-shaped cross-section.

4. The header of a heat exchanger of claim 1, wherein each side wall of said tank member is inclined outwardly, such that each of said tips of said walls is inclined away from the other and such that an elastic force is created urging said tips against said seat member.

5. The header of a heat exchanger of claim 1, wherein a partition is disposed in said barrel and a portion of said tank member is joined to said partition and said each offset free end portion is bent inwardly by an amount corresponding to an offset amount of said free end portion.

6. The header of a heat exchanger of claim 1, wherein said bent portions extend perpendicularly to said planar plate portion.

7. The header of a heat exchanger of claim 1, wherein said cap member has a first and a second end portion and a side cap wall on each end portion of said cap member in a radial direction of said cap member, each of said side cap walls having a projectionless surface in a radially outward direction of said cap member.

* * * * *